US007959455B1

(12) United States Patent
Armstrong et al.

(10) Patent No.: US 7,959,455 B1
(45) **Date of Patent: *Jun. 14, 2011**

(54) REMOTE RELEASE OF A CABLE CONNECTOR

(75) Inventors: Michael Armstrong, Sunnyvale, CA (US); Keith J. Hocker, Cupertino, CA (US); David J. Lima, Los Altos, CA (US)

(73) Assignee: Juniper Networks, Inc., Sunnyvale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/489,028

(22) Filed: Jun. 22, 2009

Related U.S. Application Data

(62) Division of application No. 11/954,970, filed on Dec. 12, 2007, now Pat. No. 7,549,888, which is a division of application No. 11/155,793, filed on Jun. 17, 2005, now Pat. No. 7,326,075.

(51) Int. Cl.
*H01R 13/627* (2006.01)

(52) U.S. Cl. ..... 439/354; 439/344

(58) Field of Classification Search ..... 439/160, 439/299, 342, 344, 350–358, 372, 489, 542
See application file for complete search history.

(56) References Cited

U.S. PATENT DOCUMENTS

| | | | | |
|---|---|---|---|---|
| 3,874,763 | A | 4/1975 | Hoover | |
| 5,651,690 | A | 7/1997 | Klas et al. | |
| 6,431,904 | B1 | 8/2002 | Berelsman | |
| 6,461,189 | B1 | 10/2002 | Koh | |
| 6,752,538 | B1 | 6/2004 | Bates, III | |
| 6,773,298 | B2 | 8/2004 | Gutierrez et al. | |
| 6,863,556 | B2 | 3/2005 | Viklund et al. | |
| 6,918,782 | B2 | 7/2005 | Foster | |
| 7,549,888 | B1 * | 6/2009 | Armstrong et al. | 439/354 |
| 2003/0220008 | A1 | 11/2003 | Viklund et al. | |
| 2005/0124201 | A1 | 6/2005 | Lo et al. | |

OTHER PUBLICATIONS

"IP67 Push Pull Connector," Harting, Inc., www.harting.com, retrieved online Mar. 22, 2005, 1 pg.
"IEC IP67 Harsh Environment Rated Cables and Connectors," B&B Electronics Manufacturing Company, www.bb-elec.com, copyright 2005, retrieved online Mar. 22, 2005, 3 pgs.
"RJ45 Connector Virbration Resistant to IP20, With Locking Clips," www.epn-online.com, Nov. 2004, 2 pgs.

* cited by examiner

*Primary Examiner* — James Harvey
(74) *Attorney, Agent, or Firm* — Shumaker & Sieffert, P.A.

(57) ABSTRACT

An apparatus for remotely releasing a connector, e.g., an RJ-45 connector, is described. Embodiments of the invention allow a user to release a cable comprising a connector from a connector jack when the connector jack is difficult to reach. The invention may be particularly useful to release cables from devices comprising an array of connector jacks.

20 Claims, 6 Drawing Sheets

REMOTE RELEASE OF A CABLE CONNECTOR

This application is a Divisional of application Ser. No. 11/954,970, filed Dec. 12, 2007, which is a Divisional of application Ser. No. 11/155,793, filed on Jun. 17, 2005, the entire content of which is incorporated herein by reference.

TECHNICAL FIELD

The invention relates to cables and, more specifically, cable connectors that couple cables to connector jacks.

BACKGROUND

Many devices require cable connections. One common example is a land-line telephone, which must have a telephone cable that is plugged into a telephone jack to operate. Telephone cables commonly use RJ-11 or RJ-12 connectors. Another example of a device which often uses a cable connection is a desktop computer. Desktop computers are often connected to Local Area Networks (LANs), e.g. Ethernet networks, via cables having RJ-45 connecters. The connectors not only allow cables, e.g., conductor or optical cables, to be easily plugged in and coupled to connector jacks, but also allow for quick removal from connector jacks, which is accomplished by pressing a tab of the connector. Devices using cables having connectors that allow quick connection and removal are commonplace.

There are, of course, more sophisticated devices that use great numbers of cable connections. For example, a network router may require the connection of hundreds of cables, each of which must be securely coupled to the proper connector jack. In a network router, the connector jacks for receiving the cables are generally placed as close together as possible to minimize space. With a large number of cables spaced closely together, it can be difficult to reach through a sea of cables and press the connector tab of a single cable in order to release the cable from the connector jack.

SUMMARY

In general, the invention provides techniques for remotely releasing a cable from a connector jack. The described embodiments allow for removal of connectors from a remote position, allowing a cable to be removed even if the connector jack can not be directly reached.

In this way, cable connectors may be more easily released when the connector jack located in close proximity to a large number of other connectors and, therefore, is in difficult to reach. Embodiments of this invention may also allow a person with limited dexterity to more easily release a cable from a connector jack. Additionally, some embodiments of the invention allow individual cables to be more easily identified. For example, such embodiments allow a particular cable within a large number of cables to be more easily identified before being removed from a connector jack.

In one embodiment, the invention is directed to An apparatus to release a cable connector from a connector jack comprising a handle and a rectangular extrusion coupled to the handle and sized to receive the cable connector, wherein the rectangular extrusion includes a tab actuator surface oriented to urge a tab of the cable connector to a release position when the rectangular extrusion receives the cable connector.

In another embodiment the invention is directed to an apparatus to release a cable connector from a connector jack comprising a helical coil sized to encircle a cable coupled to the cable connector; and a connector to attach the helical coil to a cable connector tab of the cable connector.

In a different embodiment, the invention is directed to a cable connector comprising one or more electrical connections to engage electrical connections of a cable connector jack, an extended release tab having a distal end and a proximal end, wherein the distal end includes a latch to secure the cable connector with the cable connector jack, and a sliding member connected to the proximal end of the extended release tab, wherein sliding member is sized to slidably move along a cable coupled to the cable connector.

In another embodiment, the invention is directed to an apparatus comprising a communication cable, a cable connector coupled to the cable for engaging a connector jack and a means for remotely releasing the cable connector from the connector jack.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
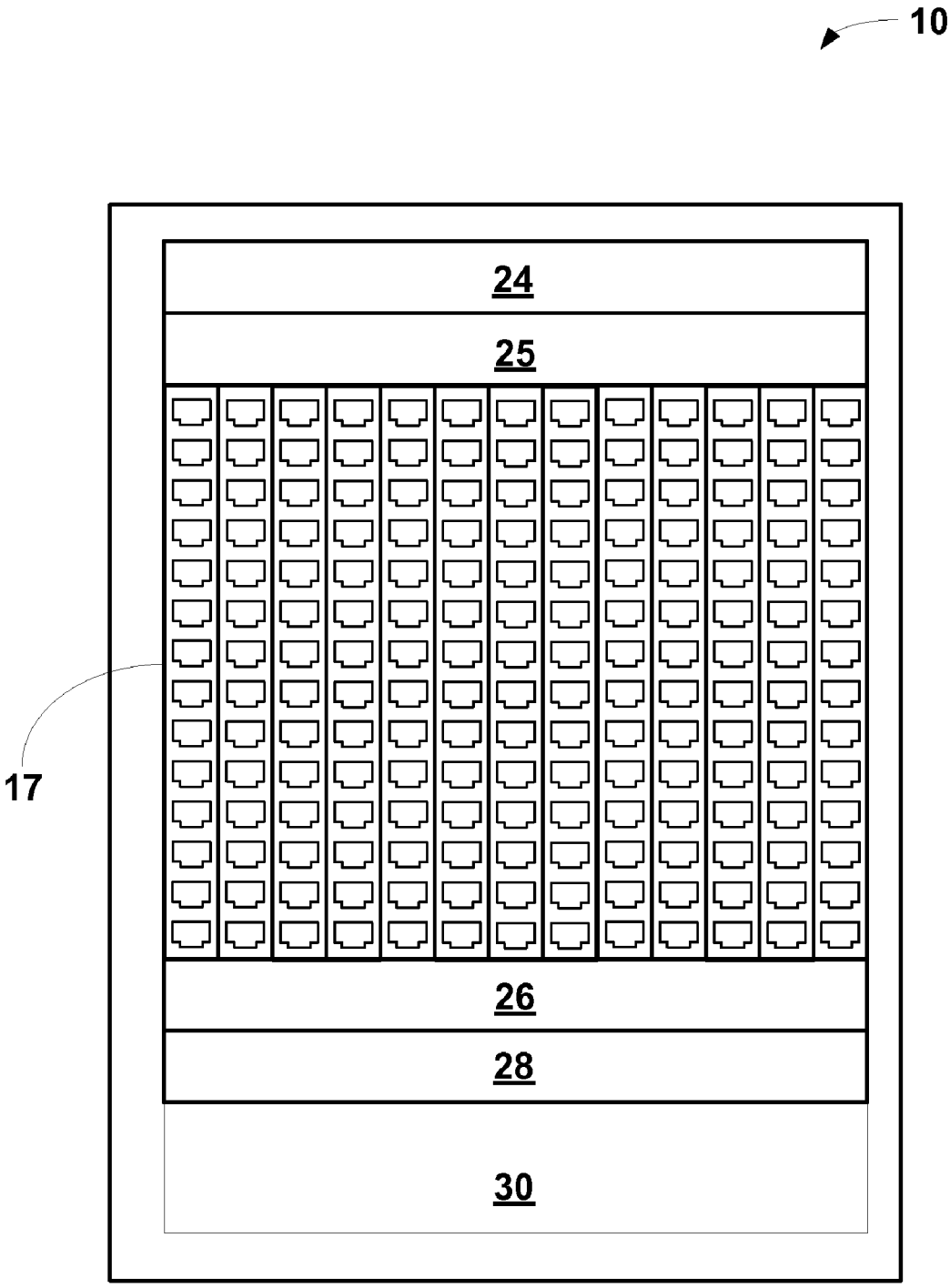
FIG. 1 is a front view illustrating a front panel of a router including a plurality of cable connector jacks.

FIG. 1 is a front view of an example router 10. Router 10 may be used to direct digital traffic on a network, e.g., an Internet service provider network. As illustrated, router 10 includes connector jacks 17, control panel 24, an upper fan tray 25, filter tray 26, lower fan tray 28 and air intake 30. Control panel 24 provides controls for configuring and utilizing router 10. Fan trays 25 and 28 provide air circulation within router 10. Filter tray 26 provides an air filter to filter the air brought in through air intake 30.

Connector jacks 17 provide interfaces to cables (not shown in FIG. 1) having connectors for physically coupling to router 10. For example, other network devices, such as routers, hubs, switches, firewalls or other devices, connect to router 10 via cables that terminate or originate at connector jacks 17.

In one embodiment, connector jacks 17 receive semi-flexible cables having RJ-45 connectors. The stiffness of the cables limits the cable bending radius, which is beneficial to ensure that conductors within the cables are not subject to excessive stress and/or strain.

While an individual cable can be bent without much force, parting a large number of cables to reach a tab on a specific one of connector jacks 17 to physically remove a cable from router 10 can be quite difficult. Additionally, even if a desired one of connector jacks 17 can be reached it may be difficult to move the tab to reach the cable. For example, other connectors can limit available space such that a user's fingers do not fit well enough press on the tab. This difficultly and others are addressed by embodiments of the invention described herein. In particular, embodiments of the invention, e.g., those shown in FIGS. 2-5, allow a cable to be removed remotely for a device, such as router 10, without requiring a user to directly engage the tab of the cable's connector. For example, a cable can be released from one of connector jacks 17 from a distance (e.g., three to five inches) from connector jacks 17 on router 10.

Router 10 is illustrated as an exemplary device for which embodiments of the described invention may be useful. In this example, router 10 comprises more than a hundred individual connector jacks 17. Other devices for which embodiments of the invention are useful may include more connector jacks or a few as a single connector jack.

Figure 2A:
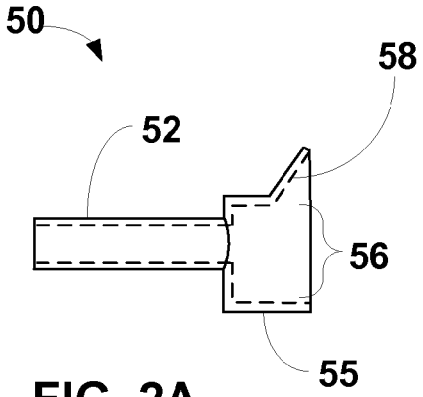
FIGS. 2A-2D are schematic diagrams illustrating a tool for remotely releasing a cable connector according to an embodiment of the invention.
Figure 2B:
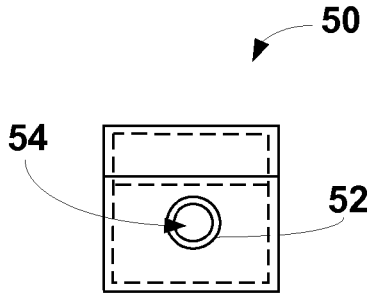
Figure 2C:
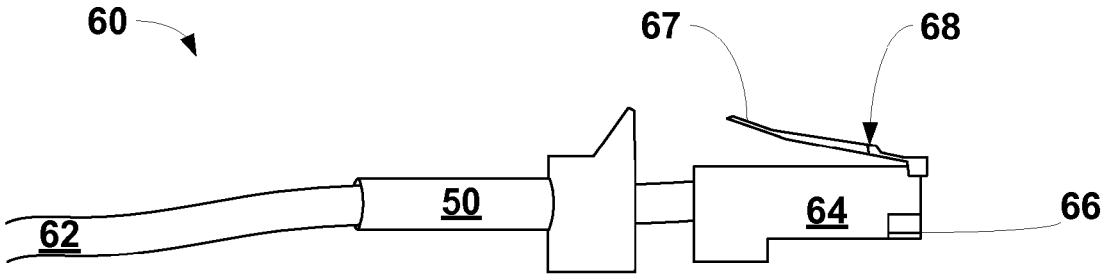
Figure 2D:
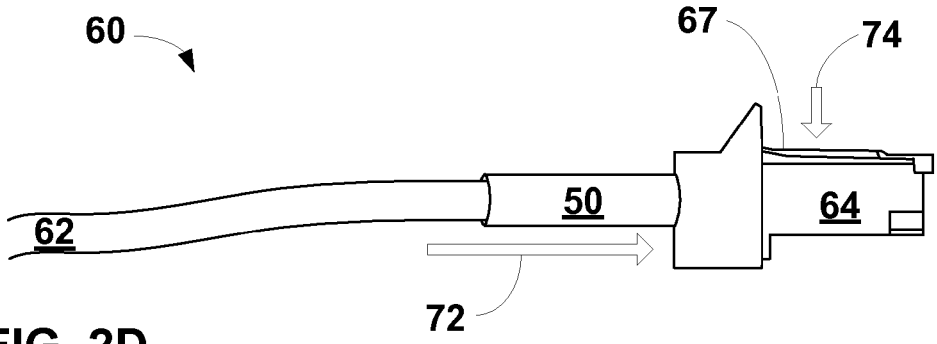

FIGS. 2A-2D show a tool 50 for remotely releasing a cable connector according to an embodiment of the invention. Specifically, FIG. 2A shows a side-view of tool 50, and FIG. 2B shows a front view of tool 50. FIGS. 2C and 2D show tool 50 in conjunction with cable end 60 according to an embodiment of the invention.

In the illustrated embodiment, tool 50 comprises cylinder 52 forming cable aperture 54 coupled to rectangular extrusion 55. Rectangular extrusion 55 includes connector aperture 56 and tab actuator surface 58. Cable end 60 comprises cable 62 and connector 64. Connector 64 comprises electrical points 66 and tab 67, which includes latch 68. Connector 64 may be, for example, an RJ-45 or RJ-11 connector.

Cylinder 52 may be at least one inch in length, and may additionally be from three to five inches in length. Cylinder 52 functions as both a cable guide to direct tool 50 to connector 64 and a handle for a user to hold. Cylinder 52 is designed to fit over cable 62. Similarly, rectangular extrusion 55 is designed to fit over connector 64. In this embodiment, cable aperture 54 is round in shape, which coincides with cable 62. Although not a requirement of the invention, other embodiments may comprise different-shaped cable apertures to coincide with different-shaped cables, e.g., a substantially rectangular aperture may coincide with a flat cable. Additionally, cable aperture 54 is somewhat larger than the diameter of cable 62 to allow tool 50 to easily slide along cable 62 as shown in FIG. 2D.

Figure 6:
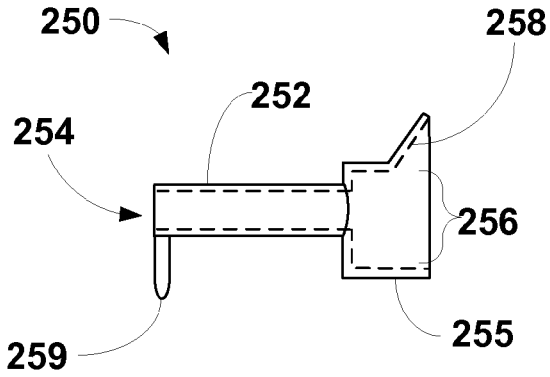
FIGS. 6-8 are schematic diagrams showing embodiments of the invention similar to those shown in FIGS. 2-5 with the additional feature of a finger grip.

Tool 50 may be pushed along cable 62 to remotely actuate tab 67 as shown in FIGS. 2C and 2D. Specifically, tool 50 may be pushed in direction 72 and over connector 64. When a user pushes tool 50 in direction 72, tab actuator surface 58 presses on tab 67, moving tab 67 in direction 74. Pushing tool 50 far enough in direction 72 moves tab 67 far enough in direction 74 so that latch 68 releases its hold on a connector jack (not shown). Then, the user can easily remove cable end 60 from the connector jack by pulling on cable 62. While the user may simply grasp cylinder 52 to push tool 50 in direction 72, other embodiments of the invention may include a finger grip to allow tool 50 to be more easily pushed in direction 72. For example, as shown in FIG. 6, a finger grip may consist of a tab extruded in a direction perpendicular to cylinder 52.

Tool 50 may be constructed as a single solid part. In such embodiments, tool 50 may be placed on cable 62 before connector 64 is installed. In other embodiments, tool 50 may comprise two or more parts; such that it may be placed on cable 62 after connector 64 is installed. For example, two parts may be designed to snap together around cable 62 to form tool 50.

Once installed, tool 50 may remain on cable 62. For example, cables that plug into connector jacks 17 on router 10 (FIG. 1) may each have a respective tool 50. If each cable has a tool 50, the tools may be individually labeled with identification markings. For example, tool 50 could be made in a plurality of colors and individually labeled with alpha-numeric characters. In this manner, a user could select a tool 50 corresponding to a desired cable connected to router 10 and disconnect the desired cable without disturbing other cable connections on router 10.

Tool 50 may consist of a polymer, metal, ceramic or other solid material. For example, tool 50 may be a polymer produced using injection molding techniques commonly known to those skilled in the art. Tool 50 could also be formed with a machining process, a combination of molding and machining, or other technique.

Figure 3A:
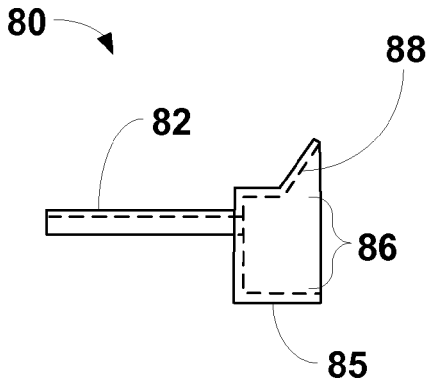
FIGS. 3A-3D are schematic diagrams illustrating a tool for remotely releasing a cable connector according to another embodiment of the invention.
Figure 3B:
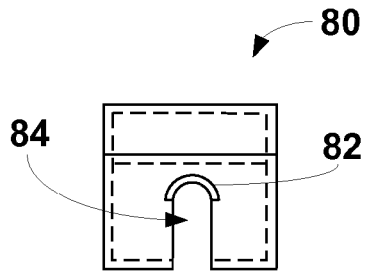
Figure 3C:
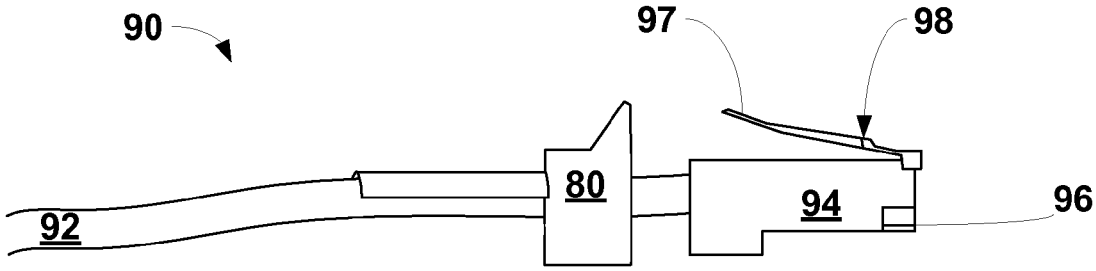
Figure 3D:
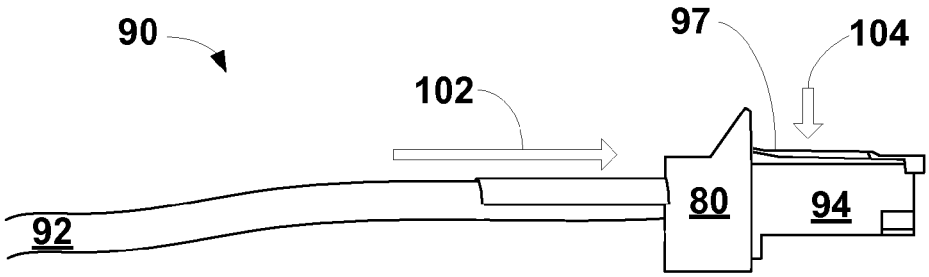

FIGS. 3A-3D show a tool 80, similar to tool 50 (FIGS. 2A-2D), for remotely releasing a cable connector according to another embodiment of the invention. As illustrated, tool 80 differs from tool 50 (FIG. 2) in that tool 80 may be used to release any number of cables, as it is not associated with a specific cable. FIG. 3A shows a side-view of tool 80, and FIG. 3B shows a front view of tool 80. FIGS. 3C and 3D show tool 80 in conjunction with cable end 90 according to an embodiment of the invention.

In this embodiment, tool 80 comprises handle 82 and rectangular extrusion 85 including connector aperture 86 and tab actuator surface 88. Handle 82 and rectangular extrusion 85 form cylindrical slot 84. Cable end 90 comprises cable 92 and connector 94. Connector 94 comprises electrical points 96 and tab 97, which includes latch 98. Connector 64 may be, for example, an RJ-45 or RJ-11 connector.

Handle 82 may be at least one inch in length, and may additionally be from three to five inches in length. Slot 84 engages cable 92, allowing tool 80 to fit over the cable. Similarly rectangular extrusion 85 is designed to fit over connector 94. In this embodiment, slot 84 has a rounded end, which coincides with round cable 92. Although not a requirement for this invention, other embodiments may comprise different-shaped slots to coincide with different-shaped cables, e.g., a substantially rectangular slot may coincide with a flat cable. Additionally, the width of slot 84 is designed to be somewhat larger than the diameter of cable 92 to allow tool 80 to easily slide along cable 92 as shown in FIG. 3D.

Tool 80 may be pushed along cable 92 to actuate tab 97 as shown in FIGS. 3C and 3D. Slot 84 functions as a cable guide to direct tool 80 to connector 94. Specifically, tool 80 may be pushed in direction 102 and over connector 94. When tool 80 is pushed in direction 102, tab actuator surface 88 presses on tab 97, and tab 97 moves in direction 104. Pushing tool 80 far enough in direction 102 pushes tab 97 far enough in direction 104 so that latch 98 releases its hold on a connector jack (not shown). Then, cable end 90 can be easily removed from the connector jack by pulling on cable 92. While a user may simply grasp handle 82 to push tool 80 in direction 102, other embodiments may include a finger grip to allow tool 80 to be more easily pushed in direction 102. For example, similar to the embodiment shown in FIG. 6, the finger grip may consist of a tab extruded in a direction perpendicular to handle 82.

Tool 80 may be constructed as a single solid part. In other embodiments, tool 80 may comprise two or more parts. In either case, tool 80 is intended to be used with multiple cables. In comparison, tool 50 (FIGS. 2A-2D) may be used with a single cable as it can not be easily removed from cable 62.

Tool 80 may consist of a polymer, metal, ceramic or other solid material. For example, tool 80 may be a polymer produced injection molding techniques commonly known to those skilled in the art. Tool 80 could also be formed with a machining process, a combination of molding and machining, or other technique.

Figure 4A:
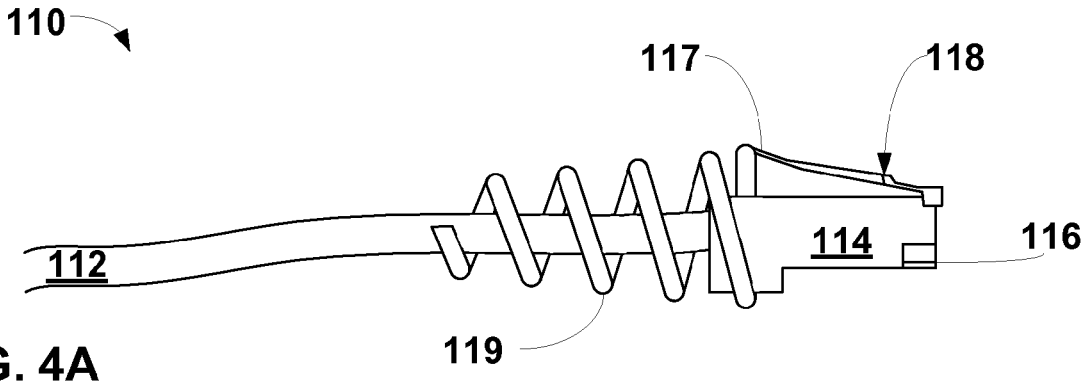
FIGS. 4A-4C are schematic diagrams illustrating a tool for remotely releasing a cable connector according to another embodiment of the invention.
Figure 4B:
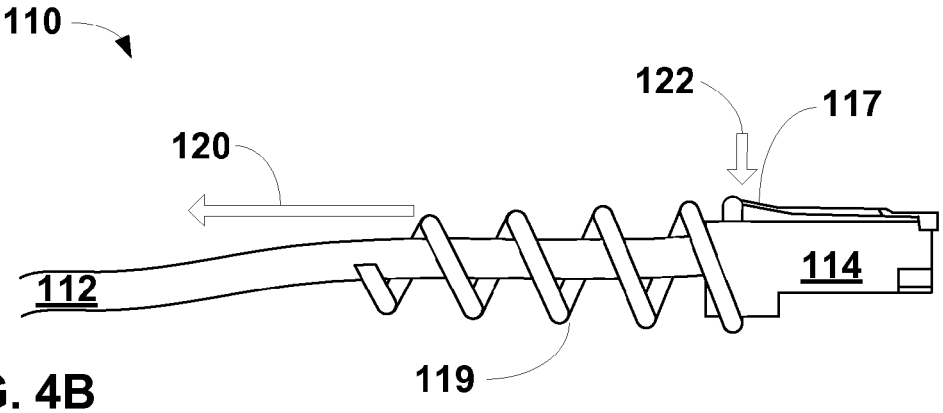
Figure 4C:
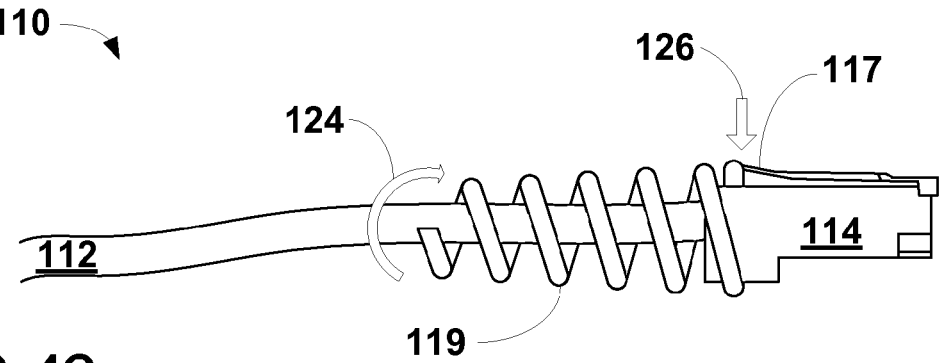

FIGS. 4A-4C show cable end 110 including cable 112, cable connector 114 and release member 119. Release member 119 allows a user to remotely release cable 112 from a connector jack according to an embodiment of the invention. Connector 114 comprises electrical points 116 and tab 117, which includes latch 118. In this example, release member 119 comprises a helical conical spring and is attached to tab 117. Specifically, FIG. 4A shows release member 119 in a relaxed position. FIGS. 4B and 4C each show a method of actuating tab 117 using release member 119 according to an embodiment of the invention.

FIG. 4A shows release member 119 in a relaxed position. Release member 119 consists of a flexible material having a high resilience, i.e., resistance to inelastic deformation. Because release member 119 is flexible, it will not adversely limit the flexibility of cable 112. As shown in FIG. 2A, release member 119 naturally aligns with cable 112 near connector 114.

FIG. 4B shows one method of using release member 119 to release cable 112 from a connector jack (not shown). Specifically, a user may pull on release member 119 in direction 120, causing tab 117 to move in direction 122. Once a user pulls with enough force, latch 118 will release connector 114 from the connector jack. Because the user is already pulling on connector 114 via release member 119 cable end 110 will pull right out of the connector jack once latch 118 releases.

Figure 7:
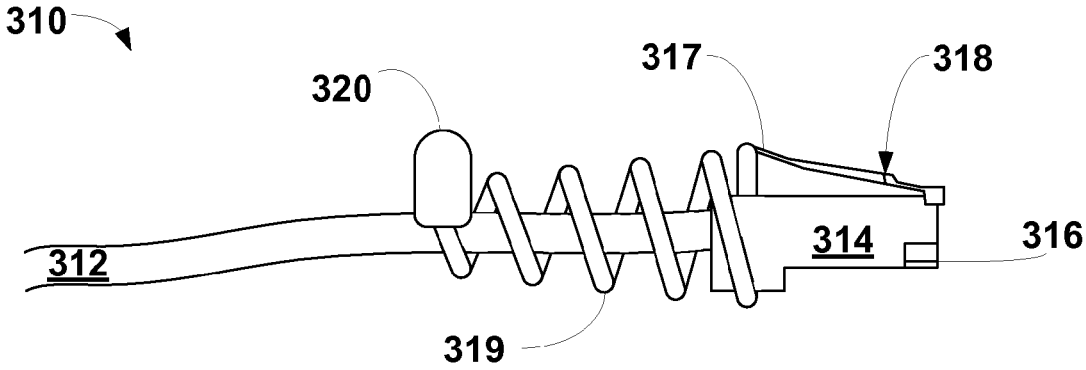

FIG. 4C shows a different method of moving tab 117 to release cable 112 from a connector jack. Specifically, a user may twist on release member 119 in direction 124, causing tab 117 to move in direction 126. Once a user twists release member 119 far enough, latch 118 will release its hold on the connector jack. Then, cable end 110 can be easily removed from the connector jack by pulling on cable 112. While a user may simply grasp release member 119 and pull in direction 120 or twist in direction 124, other embodiments may additionally comprise a finger grip to allow release member 119 to be more easily manipulated. For example, as shown in FIG. 7, the finger grip may be connected to release member 119 at the opposite end of connector 114. The finger grip may consist of one or more tabs extruded in a direction perpendicular to cable 112.

Release member 119 may extend in a linear direction at least an inch from the base of connector 114; additionally, release member 119 may extend in a linear direction three to five inches from the base of connector 114.

Release member 119 is designed to fit over cable 62. In this embodiment, release member 119 is a conical spring, but in other embodiments a simple helical spring may be used. Release member 119 is attached to tab 117. In some embodiments, release member 119 may be manufactured as part of connector 114. In other embodiments, release member 119 may be added to connector 114. If release member 119 is added to connector 114, it may be added either before or after connector 114 is coupled to cable 112. Release member 119 could be attached to tab 117 in any manner known to those skilled in the art. For example, release member 119 may be manufactured as a single part with tab 117 and connector 114, glued to tab 117 or riveted to tab 117.

Release member 119 is generally designed to remain on cable end 112, although other embodiments may allow release member 119 to be used on multiple cables. For example, each cable that plugs into connector jacks 17 on router 10 (FIG. 1) may have its own release member 119. If each of the cables has a release member 119, each release member may be individually labeled. For example, each release member 119 could be made in one or a plurality of colors and individually labeled, e.g. given a sticker with alpha-numeric characters. For example, a user of release member 119 may then readily determine which cable connected to router 10 should be removed.

Release member 119 may consist of a polymer, metal or other elastic material having sufficient resilience to avoid plastic deformation when release member 119 is pulled or twisted with enough force to release connector 114. For example, device 114 may comprise a metal wire wrapped to form a conical spring.

Figure 5A:
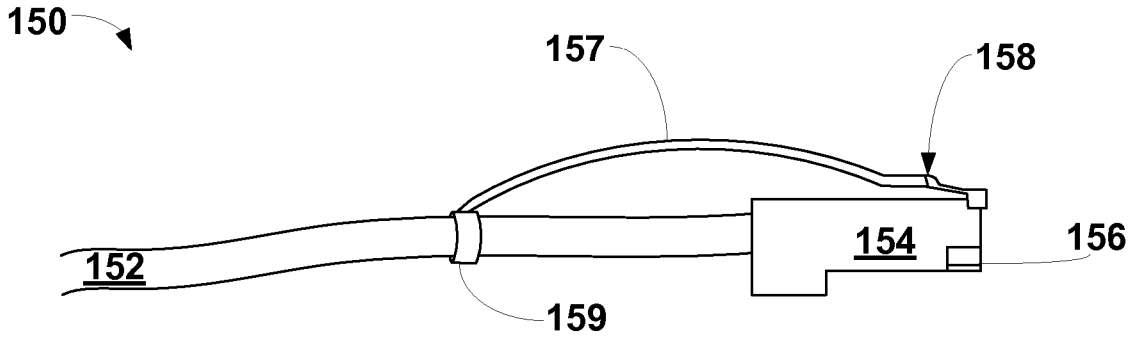
FIGS. 5A and 5B are schematic diagrams showing a cable connector having an extended release tab allowing a cable to be remotely released according to another embodiment of the invention.
Figure 5B:
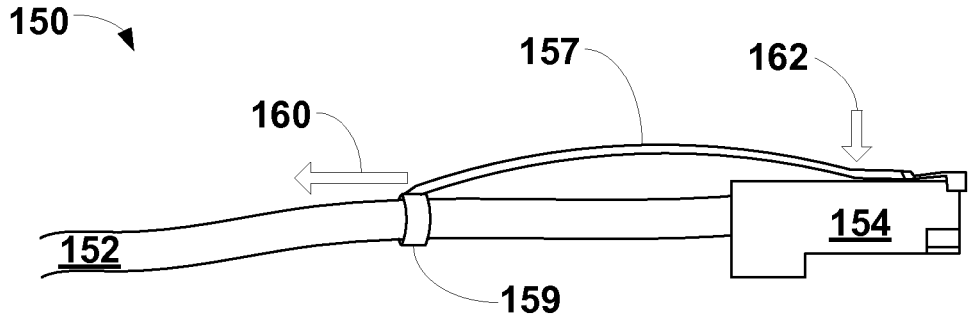

FIGS. 5A and 5B show cable end 150 comprising cable 152 and connector 154 with an extended release tab 157 that allows cable end 150 to be remotely released from a connector jack according to an embodiment of the invention. Connector 154 comprises electrical points 156 and tab 157, which includes latch 158 and sliding ring 159. Specifically, FIG. 5A shows extended tab 157 in a relaxed position, while FIG. 5B shows a method of actuating tab 157 by pulling on sliding ring 159 according to an embodiment of the invention.

Tab 157 may extend at least and inch from the base of connector 154; additionally, tab 157 may extend three to five inches from the base of connector 154. Slider 152 on the end of tab 157 may prevent tab 157 from being accidentally pressed, which could release connector 154 from a connector jack.

Slider ring 159 is designed to fit over cable 152. In this embodiment, sliding ring 159 is round in shape, which coincides with cable 152. Although not a requirement for this invention, other embodiments may comprise different-shaped sliding members to coincide with different-shaped cables, e.g., a substantially rectangular slider may coincide with a flat cable. Additionally, sliding ring 159 is designed to be somewhat larger than the diameter of cable 152 to allow sliding ring 159 to easily slide along cable 152 as shown in FIG. 5B.

Sliding ring 159 may be pulled along cable 152 to move tab 157 as shown in FIG. 5B. Specifically, sliding ring 159 may be pulled in direction 160. When sliding ring 159 is pulled in direction 160, tab 157 moves in direction 162. Pulling sliding ring 159 far enough in direction 160 releases latch 158 from a connector jack (not shown). Alternately, a user could press on extended tab 157 in order to release latch 158 from a connector jack. In either case, once latch 158 is released, cable end 150 may be easily removed from the connector jack by pulling on cable 152.

Figure 8:
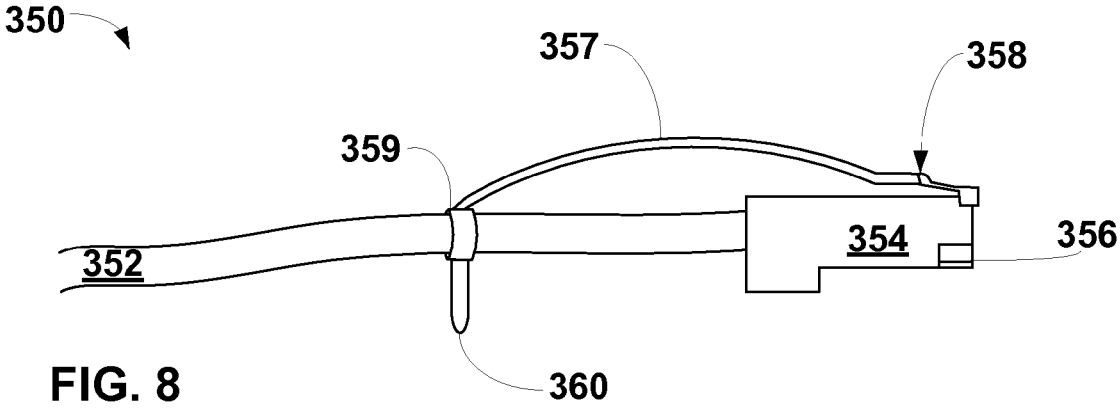

While a user may simply grasp sliding ring 159 and pull to release connector 154 from a connector jack, other embodiments may additionally comprise a finger grip to allow sliding ring 159 to be more easily pulled in direction 160. For example, as shown in FIG. 8, the finger grip may consist of a tab connected to sliding ring 159 and extruded in a direction perpendicular to the length of cable 152.

Connector 154 including extended tab 157 and sliding ring 159 may consist of a polymer, metal or other flexible material. For example, connector 154 may be a polymer produced with injection molding techniques commonly know to those skilled in the art. Connector could also be formed with a machining process, a combination of molding and machining, or other technique.

FIG. 6 is a schematic diagram showing an embodiment of the invention similar to those shown in FIGS. 2 and 3 with the additional feature of finger grip 259. Specifically, FIG. 6 shows a tool 250 for remotely releasing a cable connector according to an embodiment of the invention. In the illustrated embodiment, tool 250 comprises a cylinder 252 forming a cable aperture 254 coupled to rectangular extrusion 255. Rectangular extrusion 255 includes a connector aperture 256 and tab actuator surface 258. Finger grip 259 is coupled to cylinder 252. Finger grip 259 allows easy operation of tool 250, as described in the detailed description of FIGS. 2 and 3.

FIG. 7 is a schematic diagram showing an embodiment of the invention similar to that shown in FIG. 4 with the additional feature of finger grip 320. Specifically, FIG. 7 shows cable end 310 including a cable 312, cable connector 314 and release member 319, which includes finger grip 320. Release member 319 allows a user to remotely release a cable 312 from a connector jack according to an embodiment of the invention. Connector 314 comprises electrical points 316 and tab 317, which includes latch 318. In this example, release member 319 comprises a helical conical spring and is attached to tab 317. Finger grip 320 allows easy operation of release member 319, as described in the detailed description of FIG. 4.

FIG. 8 is a schematic diagram showing an embodiment of the invention similar to that shown in FIG. 5 with the additional feature of finger grip 360. Specifically, FIG. 8 shows cable end 350 comprising cable 352 and connector 354 with extended release tab 357 that allows cable end 350 to be remotely released from a connector jack according to an embodiment of the invention. Connector 354 comprises electrical points 356 and tab 357, which includes latch 358 and sliding ring 359. Finger grip 360 allows easy operation of sliding ring 359, as described in the detailed description of FIG. 5.

Various embodiments of the invention have been described. Nevertheless, it will be understood that various modifications may be made without departing from the spirit and scope of the invention. For example, described embodiments of the invention could be readily adapted for use with optical cables. These and other embodiments are within the scope of the following claims.

The invention claimed is:

1. An assembly comprising:

a cable;

a cable connector on an end of the cable, the cable connector including a cable connector tab operable to release the cable connector from a connector jack; and an apparatus to release the cable connector from the connector jack comprising a helical coil encircling the cable, wherein the helical coil is attached to the cable connector tab of the cable connector.

2. An apparatus to release a cable connector from a connector jack comprising a helical coil sized to encircle a cable coupled to the cable connector, wherein the helical coil is configured to attach to a cable connector tab of the cable connector.

3. The assembly of claim 1, wherein the helical coil is a conical helical coil.

4. The assembly of claim 1, further comprising a finger grip on an end of the helical coil opposite to the connector.

5. The assembly of claim 1, wherein the cable connector is selected from a group consisting of:

an RJ-45 connector; and an RJ-11 connector.

6. The apparatus of claim 1, wherein the helical coil is between three and five inches in length as measured along its axis.

7. The assembly of claim 1, wherein pulling on an end of the helical coil opposite to the connector releases the cable connector from the connector jack.

8. The assembly of claim 1, wherein twisting an end of the helical coil opposite to the connector to tighten the helical coil around the cable releases the cable connector from the connector jack.

9. The assembly of claim 1, wherein the helical coil is manufactured as a single part with the cable connector tab of the cable connector.

10. The assembly of claim 1, wherein the helical coil extends in a linear direction at least an inch from a base of the cable connector.

11. The apparatus of claim 2, wherein the helical coil is a conical helical coil.

12. The apparatus of claim 2, further comprising a finger grip on an end of the helical coil opposite to the connector.

13. The apparatus of claim 2, wherein the cable connector is selected from a group consisting of:

an RJ-45 connector; and an RJ-11 connector.

14. The apparatus of claim 2, wherein the helical coil is between three and five inches in length as measured along its axis.

15. The apparatus of claim 2, wherein the helical coil is configured to facilitate releasing the cable connector from the connector jack by pulling on an end of the helical coil opposite to the connector.

16. The apparatus of claim 2, wherein the helical coil is configured to facilitate releasing the cable connector from the connector jack by twisting an end of the helical coil opposite to the connector to tighten the helical coil around the cable and release the cable connector from the connector jack.

17. The assembly of claim 7, wherein the helical coil has sufficient resilience to avoid plastic deformation when the helical coil is pulled with enough force to release the cable connector from the connector jack.

18. The assembly of claim 8, wherein the helical coil has sufficient resilience to avoid plastic deformation when the helical coil is twisted with enough force to release the cable connector from the connector jack.

19. The apparatus of claim 15, wherein the helical coil has sufficient resilience to avoid plastic deformation when the helical coil is pulled with enough force to release the cable connector from the connector jack.

20. The apparatus of claim 16, wherein the helical coil has sufficient resilience to avoid plastic deformation when the helical coil is twisted with enough force to release the cable connector from the connector jack.

* * * * *